United States Patent [19]

Hikosaka

[11] Patent Number: 4,754,621

[45] Date of Patent: Jul. 5, 1988

[54] CONTINUOUS TENSIONLESS TREATMENT FOR CLOTH

[76] Inventor: Hiroshi Hikosaka, 376-2, Aza-Shinden, Hiruma-cho, Tushima-shi, Aichi-ken, Japan

[21] Appl. No.: 932,260

[22] Filed: Nov. 19, 1986

[30] Foreign Application Priority Data

Jan. 14, 1986 [JP] Japan ..... 61-004262

[51] Int. Cl.[4] ..... D06B 3/34

[52] U.S. Cl. ..... 68/152; 68/155; 226/164

[58] Field of Search ..... 226/162, 163, 164; 68/152, 155, 156

[56] References Cited

U.S. PATENT DOCUMENTS

| | | | |
|---|---|---|---|
| 2,985,352 | 5/1961 | Kuhlmann | 226/164 X |
| 3,064,459 | 11/1962 | Messinger . | |
| 3,359,763 | 12/1967 | Koshino | 68/155 |
| 3,943,743 | 3/1976 | Wetzels et al. | 226/164 X |
| 4,047,404 | 9/1977 | Hayashi | 68/152 |
| 4,409,709 | 10/1983 | Sando et al. . | |

FOREIGN PATENT DOCUMENTS

| | | |
|---|---|---|
| 2007422 | 9/1971 | Fed. Rep. of Germany . |
| 1230246 | 7/1959 | France . |
| 1410143 | 9/1964 | France . |
| 2017504 | 3/1970 | France . |
| 2284702 | 9/1976 | France . |
| 59-5701 | 2/1984 | Japan . |
| 1260039 | 1/1972 | United Kingdom . |
| 1514327 | 6/1978 | United Kingdom . |

*Primary Examiner*—Harvey C. Hornsby
*Assistant Examiner*—Frankie L. Stinson
*Attorney, Agent, or Firm*—Armstrong, Nikaido, Marmelstein & Kubovcik

[57] ABSTRACT

In a continuous tensionless treatment device for cloth, comprising a treatment liquid bath, a feed device for feeding a cloth being wavily curved, an upper cradle, a lower cradle and drive means of these cradles, each of horizontal beams arranged in the upper cradle for performing cloth crumpling action and washing action is composed of a first horizontal beam having V-like slant surfaces, a second horizontal beam hanging a member having many small through holes, and a partition plate arranged between both beams. These three members are arranged in prescribed relation so that in a space (stirring chamber) between the first horizontal beam and the second horizontal beam the treatment liquid is subjected to the rapid stirring flow.

3 Claims, 4 Drawing Sheets

CONTINUOUS TENSIONLESS TREATMENT FOR CLOTH

BACKGROUND OF THE INVENTION

1. Field of the Invention

The invention relates to a continuous tensionless treatment device for cloth, which is suitable for washing, relax of cloth and creping of the strong twisted threads fabrics.

2. Description of the Prior Art

A continuous tensionless treatment device for cloth in the prior art as disclosed in Japanese patent publication No. 5701/1984, comprises a number of horizontal beams with triangular cross-section arranged in parallel to each other and between lower portions of opposite sides of a board frame at regular intervals and having the lower surface formed into V-like slant surfaces, a porous board for closing top end portions of downward widening spaces enclosed by the adjacent horizontal beams and the opposite sides of the board frame, an upper cradle including a reservoir formed within the board frame on upper side of the porous board, a treatment bath with a device for advancing a continuous wavy-curved cloth being close to the liquid surface in the perpendicular direction to the horizontal beam, and a device for providing the downward speed to spout the liquid upward from the small through holes of the porous board during downward motion of the upper cradle and moving the horizontal beam member of the upper cradle repeatedly into or out of the liquid within the treatment bath.

In the prior art, the cloth crumpling action is performed only when the horizontal beam of the upper cradle in downward motion gets in the liquid and the liquid is spouted upward from the small through holes of the porous board and the wavily curved cloth accompanying the spouted liquid collides on the porous board, and when the liquid in the reservoir separates the wavily curved cloth from the porous board and rapidly flows down by the acceleration during upward motion of the upper cradle. Consequently, the crumbling efficiency becomes lower in this constitution. If the waving of the liquid surfrace of the treatment bath is prevented so that the cloth crumpling action can be attained, the number of up-and-down motion per minute is suppressed to 120 times or less. When a thick cotton or woolen cloth is relaxed, the cloth treatment speed cannot be raised and request of increasing the treatment speed by the subsequent cloth treatment device cannot be met.

SUMMARY OF THE INVENTION

In a continuous tensionless treatment device for cloth, comprising a treatment liquid bath, a feed device for feeding a cloth being wavily curved, an upper cradle, a lower cradle and drive means of these cradles, each of horizontal beams arranged in the upper cradle for performing cloth crumpling action and washing action is composed of a first horizontal beam having V-like slant surfaces, a second horizontal beam hanging a member having many small through holes, and a partition plate arranged between both beams. These three members are arranged in prescribed relation so that in a space (stirring chamber) between the first horizontal beam and the second horizontal beam the treatment liquid is subjected to the rapid stirring slow.

An object of the invention is to perform curmpling action and washing action of horizontal beams arranged in the upper cradle efficiently.

A second object of the invention is to perform the treatment at speed of 2–2.5 times in comparision to a continuous tensionless treatment device for cloth in conventional type.

DESCRIPTION OF THE PREFERED EMBODIMENT

Figure 1:
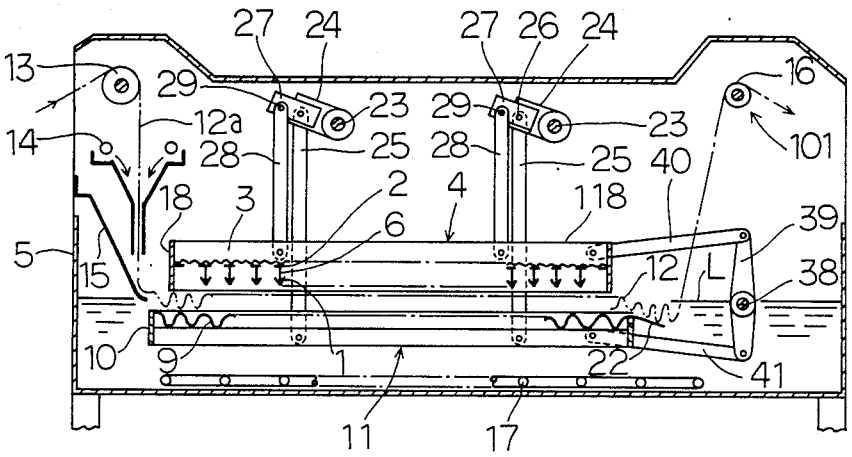
FIG. 1 is a front view in longitudinal section of a continuous tensionless treatment device for cloth as an embodiment of the invention (sectional view taken in line I—I of FIG. 4)

Referring to the drawings an embodiment will now be described. A wave-shaped porous board 9 waving in the cloth sending direction is installed within a board frame 10 of rectangular plane form, and a lower cradle 11 including the porous board 9 and the board frame 10 is arranged under a wavily curved cloth 12. An upper cradle drive device 103 turns round an upper cradle 4 in circular or elliptical form within the vertical plane in the cloth sending direction while the upper cradle 4 remains at the horizontal state, and a lower cradle drive device 105 in interlocking with the upper cradle drive device 103 turns round the lower cradle 11 in circular or elliptical form in the reverse direction to the upper cradle 4 while the lower cradle 11 remains at the horizontal state. The upper cradle drive device 103 and the lower cradle drive device 105 are installed in a treatment liquid bath 5, so that when the upper cradle 4 is moved up and down the lower cradle 11 is moved up and down in synchronization with the upper cradle 4 by the up - and - down displacement amount less than that of the upper cradle 4 thereby the wave-shaped porous plate 9 of the lower cradle 11 is engaged with or separated from the wavily curved cloth 12. Lower half of the motion locus of the upper cradle and upper half of the motion locus of the lower cradle turn round in the cloth sending direction, and utilizing the downward speed difference between the upper cradle 4 and the lower cradle 11 the lower portion of the upper cradle 4 gets in the liquid surface L of the treatment liquid bath furiously.

The treatment liquid bath 5 is provided at cloth inlet side with a feed roller 13, and a scree 15 for curving a spread cloth **12*a* passing through shower of a treatment liquid shower pipe 14 into wavy form. The treatment liquid bath 5 is also provided at cloth outlet side opposite to the inlet side with a continuous cloth drawing - out device including a drawing - out roller 16. Numeral 17 designates a steam heat pipe for liquid in the bath, which is installed on the bottom of the treatment liquid bath. The buoyancy of air bubbles generated at the liquid heating state by the pipe 17 acts beneath the upper parts of the wavily curved cloth 12 and floats the wavily curved cloth in the position close to the liquid surface L in the treatment liquid bath. Although not shown in the figure, a suitable overflow device to enable adjustment of the height of the liquid surface L is, or course, equipped in the treatment liquid bath 5. The feed roller 13, the scree 15, a support plate 22 heareinafter described and the drawing - out roller 16 constitute a feed device 101 of the cloth 12***a*.

A first horizontal beam 1 with V-like cross-section and a second horizontal beam 2 of flat plane form on upper side thereof are welded integrally over the whole length by a partition plate 6, and both ends are welded with lower portion of opposite sides of a rectangular board frame 18 of the upper cradle 4 being less than the lower cradle 11 in width and length. A member 19 forming many small through holes between the adjacent second horizontal beams 2, 2 is made of wire netting, and the wire netting being spread on the whole second horizontal beams is held down by flat sheets 21 each plug-welded 20 on each second horizontal beams, and a reservoir 3 is formed within the board frame 18 on upper side of the wire netting.

Angle between V-like slant surfaces 1*a*, 1*a* of the first horizontal beam 1 is formed in acute angle, and water removing holes 1*b* are formed at lower side of both ends of the first horizontal beam. If the opening width between the adjacent second horizontal beams 2, 2 is nearly equal to width of the shrinkage flow portion C, distance between upper end of the first horizontal beam 1 and the wire netting 19 is preferably made equal to the upper end opening width B of the downward widening space or more. If the opening width between the adjacent second horizontal beams is made smaller, the distance between upper end of the first horizontal beam and the wire netting may be made ½ B or more.

A support board 22 for the wavily curved cloth 12 is pivotally mounted on the terminal at cloth outlet side of the lower cradle 11 with the wave - shaped porous board 9 having hole rate of 35–50% in the way that it can be rocked up and down in a definite range. Consequently, even when the lower cradle is at the upper dead point, the wavily curbed cloth can be stored on the support board 22 to some extent.

Numeral 23 designates horizontal shafts in parallel to each other being rotatably installed laterally above the treatment liquid bath at front and rear sides. The lower cradle 11 is hung horizontally through vertical links 25 to both lower cradle hanging first arms 24 which are in parallel to each other and fixed on both sides of the horizontal shafts 21. The upper cradle 4 is hung horizontally through vertical links 28 to the top end of both side arms 27, 27 which are fixed to both side arms 24 and can be adjusted rotatable up and down about a pivotal shaft 26 of each link 25 installed between the both side arms 24, 24. Numeral 29 designates a pivotal shaft of each link 28 installed between both side arms 27, 27.

The horizontal shafts 23, 23 at front and rear sides are interconnected by parallel arms 30 fixed to projections of both horizontal shafts outside the treatment liquid bath and a connecting rod 31 of both arms 30, 30. One horizontal shaft 23 is linked with an output shaft (driving shaft) 33 of a non-stage transmission 32 through a first crank mechanism 34 so as to move all of the arms 24 up and down in synchronization. The first crank mechanism 34 couples between an expandable arm 35 fixed to projection of the horizontal shaft 23 outside the treatment liquid bath and a disc-shaped crankarm 36 fixed to the output shaft 33 using a connecting rod 37. The expandable arm 35 can freely adjust the arm length by the screw mechanism.

Numeral 38 designates a horizontal shaft installed laterally to the cloth outlet end of the treatment bath 5 in rotatable state. Upper ends of levers 39 fixed respectively on both sides of the horizontal shaft 38 are connected to the upper cradle 4 with nearly horizontal links 40, and also lower ends of the levers 39 are connected to the lower cradle 11 with nearly horizontal links 41. The levers 39 are linked with the output shaft 33 of the non-stage transmission 32 through a second crank mechanism 46 and a chain wheel transmission 47.

The second crank mechanism 46 couples between an expandable arm 42 fixed to the horizontal shaft 38 outside the treatment liquid bath and a disc-shaped crank arm 44 pivotally supported 43 to side of the treatment liquid bath using a connecting rod 45. The second crank mechanism 46 is different from the first crank mechanism 34 in the dead - point phase by nearly 90 degees as shown in FIG. 3.

Both arms 24, 27, the link 28, both arms 30, the connecting rod 31, the first crank mechanism 34, the non-stage transmission 32 hereinafter described and a motor (not shown) constitute the drive device 103 of the upper cradle 4.

Also both arms 24, the link 25, both arms 30, the connecting rod 31, the second crank mechanism 46, the non-stage transmission 32, a motor (not shown) and the chain wheel transmission 47 constitute the drive device 105 of the lower cradle 11.

Figure 3:
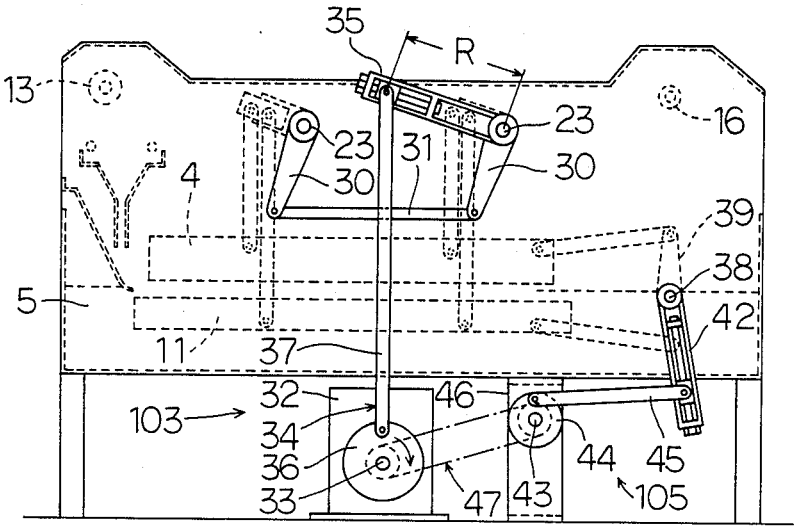
FIG. 3 is a front view of the embodiment.
Figure 4:
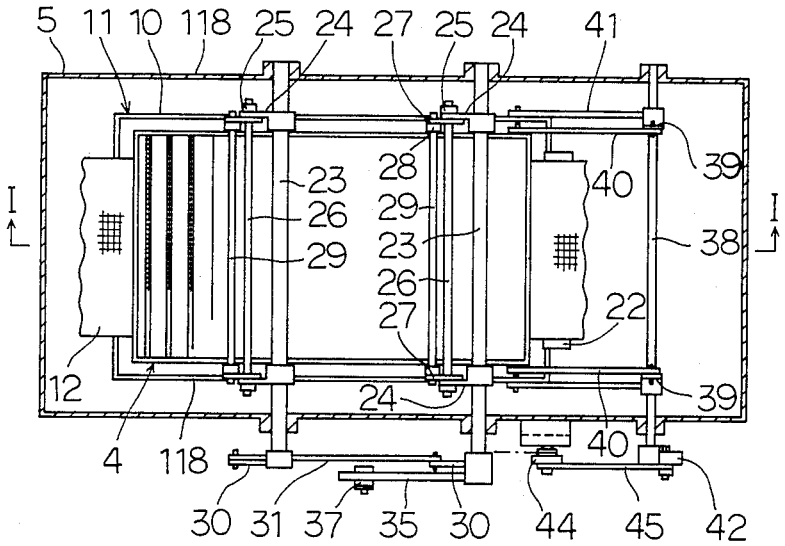
FIG. 4 is a plan view in lateral section of the embodiment.
Figure 5:
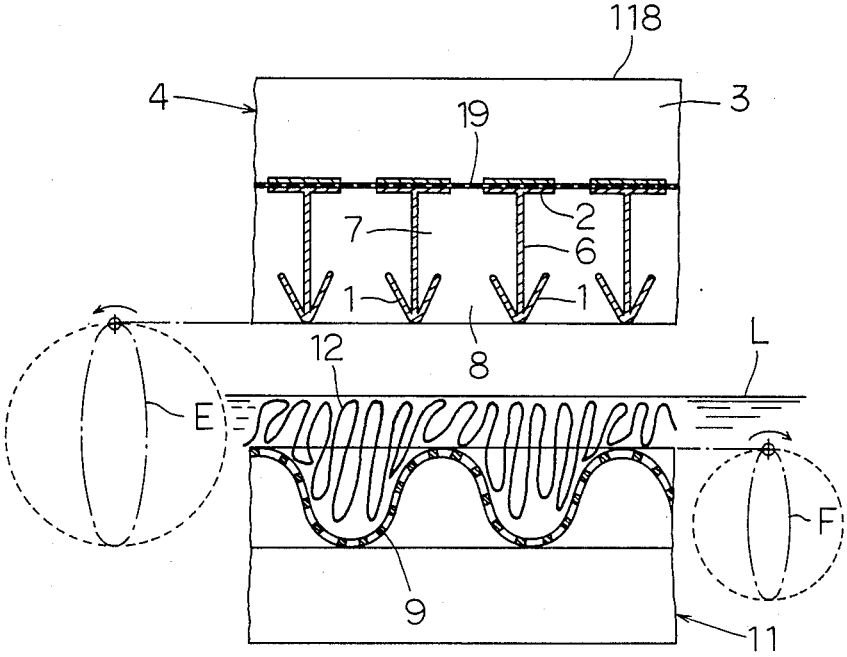
FIGS. 5–7 are longitudinal sectional views of principle part of the embodiment illustrating the operating process.
Figure 6:
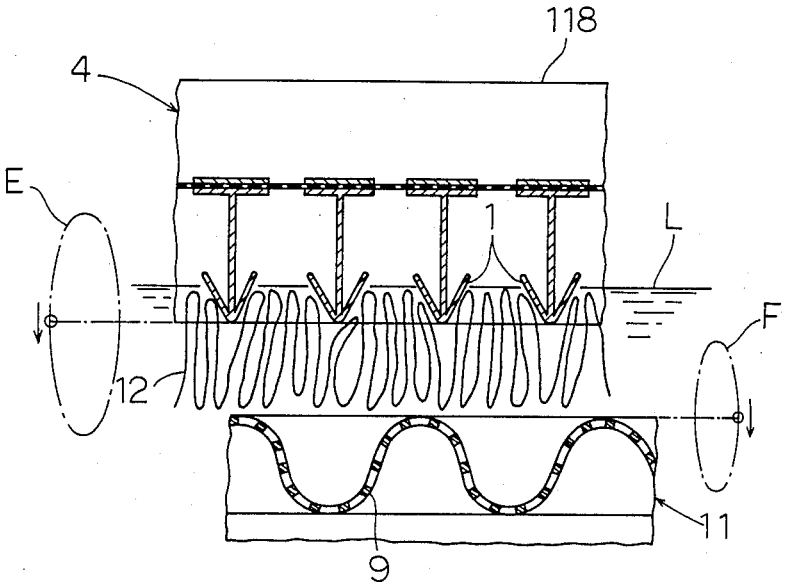
Figure 7:
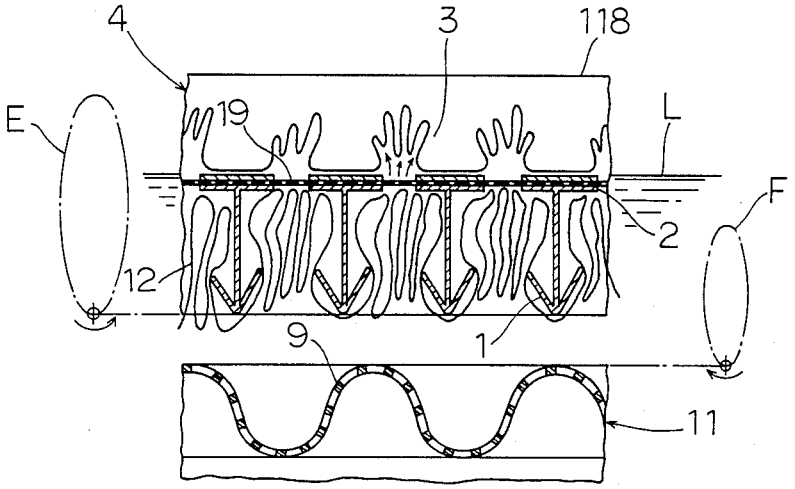

Thus when the output shaft 33 is rotated in the direction of the arrow shown in FIG. 3 through the non-stage transmission 32 by a motor (not shown), the upper cradle 4 and the lower cradle 11 move circularly or elliptically in the reverse direction to each other as shown in FIGS. 5–7, with the result that a lower half of the motion locus E of the upper cradle and an upper half of the motion locus F of the lower cradle turn round alternately in the cloth sending direction.

The up-and-down stroke of the upper and lower cradles 4, 11, i.e., the cloth crumping force can be adjusted by adjusting the length of the expandable arm 35, or the longitudinal stroke of the upper and lower cradles, i.e., the cloth sending speed can be adjusted by adjusting the length of the expandable arm 42. Corresponding to that textile fabrics are woven by either of natural fibers, synthetic fibers or mixed fibers, or are mixed-woven or mixed-knitted by these fibers, the motion loci E, F of the upper and lower cardles can be made elliptical form being long in the vertical direciton as shown in FIG. 5 or made approximately circular form as shown by dashed line in FIG. 5 or made elliptical form being long in the longitudinal direction. When the cloth amount to be stored in the treatment liquid bath is increased or decreased corresponding to the thickness of the cloth, the arm 27 may be adjusted in the up and down or rotation with respect to the arm 24 thereby the distance between the upper and lower cradles 10, 11 is increased or decreased.

In either case, the height of the liquid surface in the treatment bath may be preferably adjusted so that the wire netting 19 of the upper cradle at the lower dead point as shown in FIG. 7 is plasced slightly lower than the liquid surface L of the treatment bath at the stationary state. This is because, if the liquid surface in the treatment bath is too high, the waving on the liquid surface becomes bigger, which prevents the cloth from being supplied and transferred smoothly or may cause the zigzag traveling of the cloth. On the contrary, if the liquid surface is too low, not only the effect of crumpling the cloth is significantly dimished but also the transferring of cloth becomes unstable.

When a thick cotton or woolen cloth is relaxed, arm lengths of the expandable arms 35, 42 are adjusted respectively so that the motion loci E, F of the upper and lower cradles become elliptical form being long in the vertical direction as shown in FIGS. 5–7. In the situation shown in FIG. 5 corresponding to FIG. 1, the upper cradle 4 at the upper dead point turns round above the liquid surface L in the direction of the arrow, and the wave-formed porous board 9 of the lower cradle 11 at the upper dead point turns round reversely in the direction of the arrow as linking with the lower part of the wavily curved cloth 12, resulting in crumpling the cloth slightly while sending the waving curved cloth in the cloth sending direction (right side in the figure).

When the upper and lower cradles turn round in 90 degrees from this situation, the first horizontal beam 1 of the upper cradle begins to get rapidly into the liquid surface L and the wave-formed porous board 9 of the lower cradle is nearly left from the waving curved cloth 12 and stops the cloth sending motion as shown in FIG. 6.

When the upper and lower cradles turn round further in 90 degress and attains to the lower dead point, the first and second horizontal beams 1, 2 of the upper cradle sinks rapidly into the liquid as shown in FIG. 7, and the strong crumpling motion is performed as above described and the wavily curved cloth 12 is advanced in the cloth sending direction. While the upper and lower cradles turn round further in 90 degrees from this situation, the liquid falling down from the reservoir 3 of the upper cradle recovers the situation that wavily curved cloth is floated and held by the liquid. And then the situation similar to FIG. 5 is recovered where the wave-shaped porous plate 9 is engaged with the wavily curved cloth.

Although the embodimeht has been described where the device for advancing the wavily curved cloth close to the liquid surface in the perpendicular direction to the first and second horizontal beams 1, 2 and other device for moving the first and second horizontal beam portions of the upper cradle into or out of the liquid in the treatment bath repeatedly cooperate with each other, the invention includes the case that both devices are constituted separately in similar manner to the prior art disclosed in Japanese patent publication No. 5701/1984.

Action of the cobntinuous tensionless treatment device for cloth in the embodiment will be described.

Figure 2:
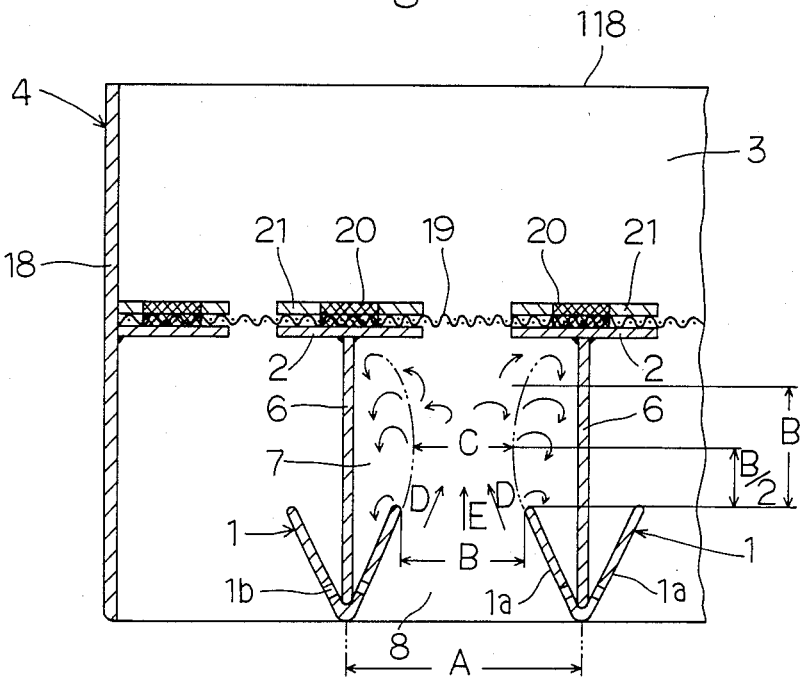
FIG. 2 is an enlarged view of principal part of an upper cradle of the embodiment.

Liquid near the liquid surface of the treatment bath includes many air bubbles as the upper cradle is moved in and out. When the upper cradle is moved down, the adjacent first horizontal beams 1, 1 get into the liquid surface L of the treatment bath furiously at first, and the liquid of width A (FIG. 2) removed by both first horizontal beams is compressed and accelerated while it is going up relatively through the downward widening space 8.

Next, as the upper cradle is moved down, the liquid is spouted through the upper end opening of the downward widening space 8 into the stirring chamber 7 in sequence, and the spouted flow along the opposite slant surfaces 1*a*, 1*a* of the space 8 produces the shrinkage flow portion C. According to the collision action between both spouted flows D, D and the center spouted flow E and the expansion action of the contained air bubbles, the whole spouted flows (D, E) spread over the cloth sending direction and the upward speed is decreased and many air bubbles are produced in the stirring chamber, thereby the wavily curved cloth accompanying the spouted flow and forced into the stirring chamber is stirred by the air bubbles and subjected to the sufficient crumpling operation and the washing operation. Since the shrinkage flow portion C is produced above the upper end of the downward widening space 8 by about ½ of its opening width B, the vertical distance of the first and second horizontal beams 1, 2 may be made larger than ½ B.

When the uppr cradle attains near the lower dead point and the liquid passing through the stirring chamber passes through the many small through holes provided between the adjacent second horizontal beams 2, 2, since the total area of the through holes is smaller than the upper end opening area of the downward widening space 8, the liquid passing through the small through holes is accelerated again the spouted into the reservoir 3 as shown in FIG. 7, thereby upper portion of the wavily curved cloth accompanying the spouted liquid is bundled and engaged with the small through hole boring member 19 and subjected again to the crumpling action and the washing action.

Next, when the upper cradle begins to rise, its acceleration makes the liquid in the reservoir 3 flow down rapidly from the small through holes while pushing the wavily curved cloth apart from the small through hole boring member 19, thereby the cloth is subjected to the crumpling action and the washing action similarly to conventional method.

Accordingly, the wavily curved cloth advanced close to the liquid surface in sequence is subjected to the sufficient crumpling action and the washing action uniformly when the first and second horizontal beam parts of the upper cradle are moved into and out of the liquid repeatedly varying the curved positions of the cloth, irrespective of the waving state of the liquid surface of the treatment bath, thereby the tangle between the wavily curved cloth in the adjacent stirring chambers 7, 7 can be prevented by the partition plate 6 therebetween.

What is claimed is:

1. A continuous tensionless treatment device for cloth, comprising:

(a) a liquid treatment bath;

(b) means for feeding a cloth in a wavily curved form to the liquid treatment bath and for maintaining said wavily curved cloth close to the surface of said liquid treatment bath;

(c) An upper cradle having a rectangular frame mounted above said wavily curved cloth in said liquid treatment bath; said rectangular frame having laterally spaced side walls extending in the direction said cloth is fed to said liquid treatment bath;

(d) a plurality of first horizontal beams extending between the lower ends of said sidewalls, said first horizontal beams being perpendicular to the direction of movement of said wavily curved cloth, parallel to each other and having V-like slant surfaces forming a downward widening space open at the upper and lower ends thereof between adjacent ones of said first horizontal beams;

(e) a plurality of second horizontal beams extending between said sidewalls with each second horizontal beam above one of said first horizontal beams, said second horizontal beams being in spaced parallel relation to each other with the spacing between adjacent ones of said second horizontal beams being narrower than the spacing between said V-like slant surfaces at the upper end of said downward widening space and the vertical distance between said first and second horizontal beams being larger than one-half of said spacing between said V-like slant surfaces at the upper end of said downward widening space;

(f) a member hung between the second horizontal beams and having many small through holes;

(g) a plurality of partition plates with each partition plate extending between said sidewalls and connecting one of said first horizontal beams to one of said second horizontal beams and with an adjacent partition plate forming a stirring chamber between each downward widening space and the member having many small through holes, each said partition plate being separated from an adjacent partition plate by a distance wider than said spacing between said V-like slant surfaces at the upper end of said downward widening space; and (h) an upper cradle drive device for moving the upper cradle accompanied by the wavily curved cloth into or out of said liquid treatment bath, said drive device sinking the upper cradle into the treatment liquid at a speed to cause the treatment liquid to spout from the holes in said member having many small through holes as said upper cradle is moved into said liquid treatment bath.

2. A continuous tensionless treatment device for cloth as set forth in claim 1, further comprising:

a lower cradle installed under the surface of the liquid treatment bath and below the wavily curved cloth; and a drive device for said lower cradle.

3. A continuous tensionless treatment device for cloth, comprising:

(a) a liquid treatment bath;

(b) means for feeding a cloth in a wavily curved form to the liquid treatment bath and for maintaining said wavily curved cloth close to the surface of said liquid treatment bath;

(c) a horizontally disposed upper cradle having a rectangular frame mounted above said wavily curved cloth in said liquid treatment bath; said rectangular frame having laterally spaced side walls extending in the direction said cloth is fed to said liquid treatment bath;

(d) a plurality of first horizontal beams extending between the lower ends of said sidewalls, said first horizontal beams being perpendicular to the direction of movement of said wavily curved cloth, parallel to each other and having V-like slant surfaces forming a downward widening space open at the upper and lower ends thereof between adjacent ones of said first horizontal beams;

(e) a plurality of second horizontal beams extending between said sidewalls with each second horizontal beam above one of said first horizontal beams, said second horizontal beams being in spaced parallel relation to each other with the spacing between adjacent ones of said second horizontal beam being narrower than the spacing between said V-like slant surfaces at the upper end of said downward widening space;

(f) a member hung between the second horizontal beams and having many small through holes;

(g) a plurality of partition plates with each partition plate extending between said sidewalls and connecting one of said first horizontal beams to one of said second horizontal beams and with an adjacent partition plate forming a stirring chamber between each downward widening space and the member having many small through holes, each said partition plate being separated from an adjacent partition plate by a distance wider than said spacing between said V-like slant surfaces at the upper end of said downward widening space;

(h) a horizontally disposed lower cradle installed below the wavily curved cloth and having a wave-shaped porous board;

(i) a first drive means for rotating said upper cradle relative to at least one axis normal to the direction of movement of said wavily curved cloth to move said upper cradle into and out of said liquid treatment bath while maintaining said horizontal disposition of said upper cradle; and (j) a second drive means for rotating said lower cradle relative to at least one axis normal to the direction of movement of said wavily curved cloth in a direction reverse to the direction of rotation of said upper cradle while maintaining said horizontal disposition of said lower cradle, said first and second drive means being interlocked to synchronize the movement of said upper and lower cradles with said upper cradle moving in the direction of movement of said wavily curved cloth while in said liquid treatment bath.

* * * * *